US005758884A

United States Patent [19]

Flater

[11] Patent Number: 5,758,884

[45] Date of Patent: Jun. 2, 1998

[54] ROLLER BLADE TOE BRAKE

[75] Inventor: Anders H. Flater, Highland Park, Ill.

[73] Assignee: Trans-Mex Corporation, Highland Park, Ill.

[21] Appl. No.: 523,803

[22] Filed: Sep. 5, 1995

[51] Int. Cl.[6] ..... A63C 17/14

[52] U.S. Cl. ..... 280/11.2

[58] Field of Search ..... 280/11.19, 11.2, 280/11.22, 11.23, 11.27

[56] References Cited

U.S. PATENT DOCUMENTS 3,945,655 3/1976 Bonks et al. ..... 280/11.2

5,143,387 9/1992 Colla ..... 280/11.2

5,253,882 10/1993 Mitchell ..... 280/11.2

*Primary Examiner*—Richard M. Camby

[57] ABSTRACT

A roller skate toe brake includes a generally flat pedal inside the toe portion of shoes adaptable to in line roller skates. The pedal is hinged to the shoe and is movably connected to a brake pad located over one of the rollers. The pedal and brake pad are spring activated to keep the brake pad from touching the roller in the open position. When braking is desired, the skater activates the pedal which action closes the brake pad onto the roller and the skating surface to brake the roller skate. The roller skate toe brake is intended to improve the safety of roller skating and to facilitate hockey and figure skating maneuvers.

8 Claims, 1 Drawing Sheet

ROLLER BLADE TOE BRAKE

BACKGROUND OF THE INVENTION

The present invention relates, in general, to the braking of in line roller skates and is intended to promote the safety of roller skating and to facilitate hockey and figure skating maneuvers.

The braking of in line roller skates is difficult to accomplish by the movement of the skates alone and is presently carried out by the use of a brake tab protruding from the rear of one of a pair of roller skate shoes usually the right side one, and which tab is made to scrape against the ground surface to stop the movement of the skater. This procedure is accomplished as the skater is leaning back on one skate while positioning the heel of the other skate so that the brake pad may come into braking contact with the ground. This maneuver is inherently unstable as the skater is required to lean back while balancing on one leg.

Thus it would be desireable to provide a roller skate brake which could apply to both skates independently or in unison without requiring the skater to balance on one leg.

SUMMARY OF THE INVENTION

The above and other objectives of the preferred embodiment of the invention are accomplished with a pedal positioned, inside shoes adaptable to in line roller skates. The pedal is hinged to the shoe and is movably connected to a brake pad located over the roller designated for braking purposes. In one embodiment, the pedal is hinged inside a recessed portion of the shoe forming a cavity. The bottom part of the cavity contains a hole, preferably elongated, to receive the brake arm the top of which is adaptable to engage the underside of the pedal. In another embodiment, the pedal is hinged to the upper toe section of the shoe, here not shown.

The brake pad is hinged to the roller side bars whit an elongated hole and is kept in the open position by a spring anchored on the underside of the sole of the shoe. The brake pad may be locked in the open position by provision of a recess in the elongated hole which would secure the movement of the brake arm. The brake pad may be unlocked by the moving of the pedal slightly sideways to force the brake arm out of the recess.

When the pedal is actuated, the brake pad rotates to close onto the roller and the skating surface to the roller skate. The brake pad may be coated with an abrasive compound to facilitate the gripping of the roller surface. The embodiment of the present invention makes it possible for brake pads to activate two in line rollers at a time.

The roller skate brake of the present invention overcomes many of the problems connected with current roller skate braking devices which do not brake a roller and brake pad in combination on the skating surface. Thus, braking of the present invention is accomplished without required body movements and the lifting of one leg. It requires only limited pressure on the brake pedal while allowing the skater to retain full balance.

In addition to the aforementioned features, other advantages of this invention will become apparent in more detailed description which follows with reference to the accompanying drawings.

DESCRIPTION OF THE PREFERRED EMBODIMENT

Figure 1:
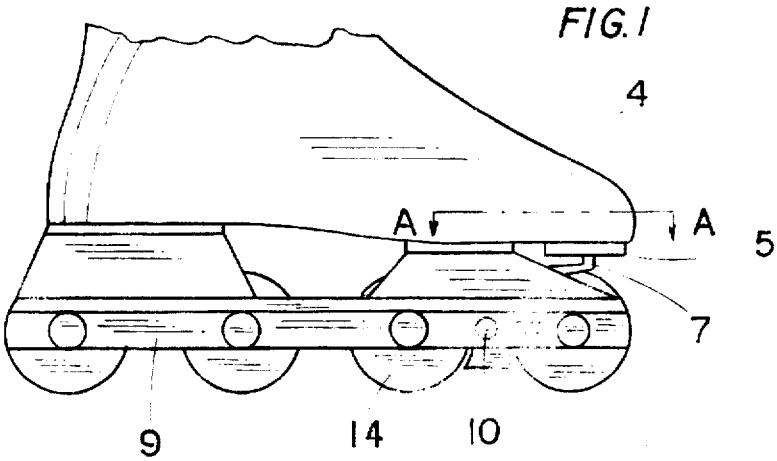
FIG. 1 is an elevational view of a roller skate with the brake.

As shown by way of example in FIG. 1 and the following description, the roller skate brake includes a pedal 1 hinged, in one embodiment, to the inner sole 2 at point 3 in the shoe 4 inside cavity 5. The pedal 1 is connected through hole 6 in cavity 5 to brake pad arm 7 containing brake pad 8. The brake pad 8 is hinged to roller bars 9 by pin 10 through elongated holes 11. The brake pad arm 7, through hole 16, is connected to spring 12 which is anchored at point 13 underneath sole 2 of the shoe 4. The movement of brake arm 7, as controlled by spring 12, is limited by the restraint of hole 6 in the open position of the roller skate brake and in the closed position by the closing of the brake pad 8 on the roller 14.

Figure 2:
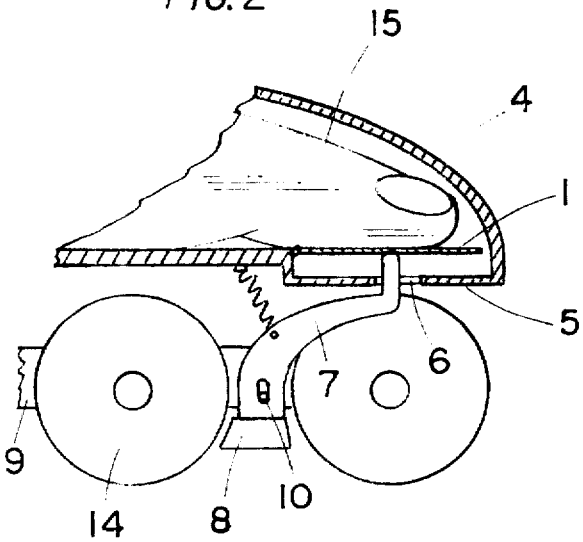
FIG. 2 is a cut-away of the toe section of a roller skate with a side elevational view of the roller skate brake.
Figure 3:
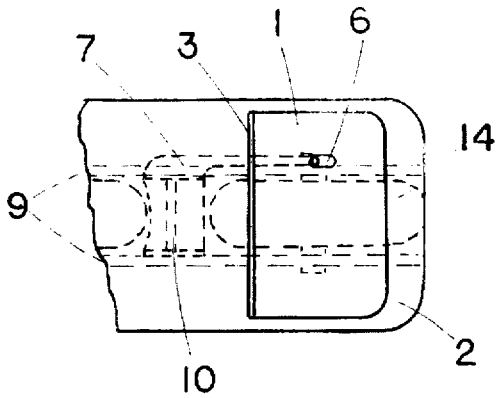
FIG. 3 is a plain view taken on line A—A of FIG. 1.
Figure 4:
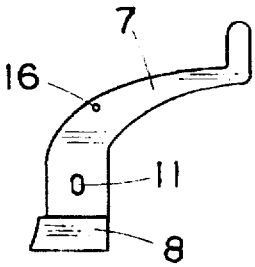
FIG. 4 is a side elevation of a brake lever and pad.
Figure 5:
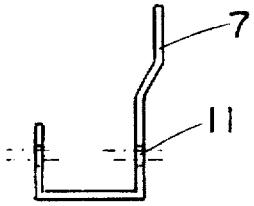
FIG. 5 is a front elevation of a brake lever.

In operation, the toe 15 in FIG. 2 activates pedal 1, which action closes brake pad 8 onto roller 14 and skating surface so as to brake the roller skate. When the pressure on pedal 1 is relieved, spring 12 returns brake pad 8 to its open position over roller 14 and skating surface. In this manner, the braking of the roller skates may be accomplished instantaneously without requiring body countermovements to upset the balance of the skater. The embodiment of the present invention permits locking of the brake pad 8 in the open position as previously described and the simultaneous braking of two inline rollers using actuating means, not shown in the drawings.

The roller skate brake of the invention may be assembled in the present state of the art roller skate shoes. The pedal may be made of plastic material and the brake pad of an abrasive compound.

In summary, a roller skate brake has been disclosed which overcomes many shortcomings of previously deviced roller skate brakes as concerns instantaneous braking without required body or leg movements.

It will be appreciated, that while essentially portraying the subject roller skate brake, the enclosed drawings should not limit the scope of the invention in general.

What is claimed is:

1. A roller skate containing wheels having a brake comprising:

a generally flat pedal movably located in said roller skate and operatively connected to actuator means, a brake lever located between two of said wheels, one of which is the brake wheel, of said roller skate, said brake lever connected to said pedal and actuator means having a first arm, a second arm and a base connecting said first arm and second arm, the first arm having a pivot point, the second arm having a pivot point opposite the pivot point of the first arm, said pivot points being elongated along an arc with the center at the axis of said brake wheel and located over the horizontal center line of said wheels, said brake lever being rotatably connected at said pivot points to said roller skate with said base oriented towards the skating surface of the roller skate when the roller skate is being used on said surface, a rotation of said brake lever when acted upon by said pedal and said actuator means, in a first direction about said pivot points urging said base towards said brake wheel and said skating surface, and a rotation of the brake lever in a second direction urging said base away from said brake wheel and said skating surface, a brake pad operatively connected to said brake lever so as to move towards and away from said brake wheel and said skating surface in concert with said brake lever, spring means operatively connected to said brake lever, said spring means urging said brake lever to rotate in said second direction so that the brake pad is urged away from said brake wheel and said skating surface and said pedal is urged into its disengaged position and;

wherein said pivot points are connected to the support structure of said roller skate thereby using the momentum of said brake wheel to urge said brake pad into braking contact with said skating surface in front of said brake wheel for stopping said roller skate when said pedal is engaged and while the angle of the skate relative to said skating surface remains constant.

2. The roller skate of claim 1, wherein said brake pad exerts braking contact with said brake wheel and said skating surface in combination and in front of said brake wheel.

3. The roller skate of claim 2, wherein more than one of said brake pad exert braking contact with more than one of said brake wheel and skating surface in combination.

4. The roller skate of claim 1, wherein said pedal is hinged to the sole of said roller skate, the sole containing a recess to accomodate the movement of the pedal when pressed down by the skater.

5. The roller skate of claim 1, wherein said pedal is hinged to the roller skate above the foot of the skater.

6. The roller skate of claim 1, wherein said pedal contains a padding on the side facing the foot of the skater.

7. The roller skate of claim 1, wherein said pedal has adjustable means for positioning.

8. The roller skate of claim 1, wherein said actuator means comprise a contact arm.

* * * * *